US006619842B1

(12) United States Patent
Artig et al.

(10) Patent No.: US 6,619,842 B1
(45) Date of Patent: Sep. 16, 2003

(54) X-RAY TUBE AND METHOD OF MANUFACTURE

(75) Inventors: Christopher F. Artig, Summit Park, UT (US); Deborah L. Salmon, Holladay, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/491,416

(22) Filed: Jan. 26, 2000

Related U.S. Application Data

(63) Continuation-in-part of application No. 09/137,950, filed on Aug. 21, 1998, now Pat. No. 6,134,299, which is a continuation-in-part of application No. 08/920,747, filed on Aug. 29, 1997, now Pat. No. 5,802,140.

(51) Int. Cl.[7] ..... H01J 35/16
(52) U.S. Cl. ..... 378/203; 378/140
(58) Field of Search ..... 378/121, 140, 378/139, 203; 250/505.1; 313/313; 315/85; 174/350; 420/430; 438/937; 427/217

(56) References Cited

U.S. PATENT DOCUMENTS 2,986,533 A * 5/1961 Kurtz ..... 428/567
4,090,103 A * 5/1978 Machenschalk et al. .... 378/144
4,303,572 A * 12/1981 Hatanaka et al. ..... 523/213
4,468,802 A * 8/1984 Friedel ..... 378/125
4,619,963 A * 10/1986 Shoji et al. ..... 524/439
4,686,417 A * 8/1987 Noji ..... 313/479
4,884,292 A * 11/1989 Klostermann et al. ..... 378/203
4,920,554 A * 4/1990 Gabbay et al. ..... 378/202
4,964,148 A * 10/1990 Klosteramnn et al. ..... 378/121
5,056,126 A * 10/1991 Klostermann et al. ..... 378/127
5,604,784 A * 2/1997 Widlicka et al. ..... 378/203
5,814,824 A * 9/1998 Hamby et al. ..... 250/515.1
5,863,492 A * 1/1999 Bose ..... 420/430
6,045,601 A * 4/2000 Tan ..... 420/430
6,062,731 A * 5/2000 Guzik ..... 378/203
6,134,299 A * 10/2000 Artig ..... 378/141
6,153,666 A * 11/2000 Lagace ..... 523/136
6,215,852 B1 * 4/2001 Rogers et al. ..... 378/203
6,252,933 B1 * 6/2001 Artig ..... 378/121
6,304,626 B1 * 10/2001 Adachi et al. ..... 378/19

* cited by examiner

*Primary Examiner*—Drew A. Dunn
(74) *Attorney, Agent, or Firm*—Workman, Nydegger & Seelay

(57) ABSTRACT

"An x-ray device component is provided that includes a substrate material upon which is deposited a bond layer, comprising a material such as copper or copper alloy, that acts to secure a powder metal shield material, comprising tungsten and iron, to the x-ray device component. The bond layer and the powder metal shield material possess thermal characteristics compatible with those of the substrate material and the powder metal shield material acts to control radiation emissions from the x-ray device."

13 Claims, 4 Drawing Sheets

X-RAY TUBE AND METHOD OF MANUFACTURE

This application is a continuation-in-part of U.S. application Ser. No. 09/137,950 filed Aug. 21, 1998, now U.S Pat. No. 6,134,299 which is a continuation-in-part of the U.S. application Ser. No. 08/920,747 filed Aug. 29, 1997, now United States Pat. No, 5,802,140, each of which is incorporated herein by reference.

BACKGROUND OF THE INVENTION

1. The Field of the Invention

The present invention relates to x-ray generating devices and their method of manufacture. More particularly, the present invention relates to an x-ray tube having an evacuated housing assembly that provides enhanced thermal stability and improved x-ray shielding characteristics. The invention also relates to methods of manufacturing the improved housing assembly.

2. The Prior State of the Art

X-ray generating devices are extremely valuable tools for use in a variety of medical and industrial applications. For example, such equipment is commonly used in areas such as medical diagnostic and therapeutic radiology.

Regardless of the particular application involved, the basic operation of x-ray devices is similar. In general, an x-ray generating device is formed with a vacuum housing that encloses an anode assembly and a cathode assembly. The cathode assembly includes an electron emitting filament that is capable of emitting electrons. The anode assembly provides an anode target that is axially spaced apart from the cathode and oriented so as to receive electrons emitted by the cathode. In operation, electrons emitted by the cathode filament are accelerated towards a focal spot on the anode target by placing a high voltage potential between the cathode and the anode target. These accelerating electrons impinge on the focal spot area of the anode target. The anode target is constructed of a high refractory metal so that when the electrons strike, at least a portion of the resultant kinetic energy generates x-radiation, or x-rays. The x-rays then pass through a window that is formed within a wall of the vacuum enclosure, and are collimated towards a target area, such as a patient. As is well known, the x-rays that pass through the target area can be detected and analyzed so as to be used in any one of a number of applications, such as a medical diagnostic examination.

In general, only a very small portion—approximately one percent in some cases—of an x-ray tube's input energy results in the production of x-rays. In fact, the majority of the input energy resulting from the high speed electron collisions at the target surface is converted into heat of extremely high temperatures. In addition, a percentage of the electrons that strike the anode will rebound from the target surface and strike other areas within the x-ray tube assembly. The collisions of these secondary electrons (sometimes referred to as "back scattered electrons) also create heat and/or result in the production of errant x-rays. This excess heat is absorbed by the anode assembly and is conducted to other portions of the anode assembly, and to the other components that are disposed within the vacuum housing. Over time, this heat can damage the anode, the anode assembly, and/or other tube components, and can reduce the operating life of the x-ray tube and/or the performance and operating efficiency of the tube.

Several approaches have been used to help alleviate problems arising from the presence of the high operating temperatures in the x-ray tube. For example, in some x-ray devices the x-ray target, or focal track, is positioned on an annular portion of a rotatable anode disk. The anode disk (also referred to as the rotary target or the rotary anode) is then mounted on a supporting shaft and rotor assembly, that can then be rotated by some type of motor. During operation of the x-ray tube, the anode disk is rotated at high speeds, which causes the focal track to continuously rotate into and out of the path of the electron beam. In this way, the electron beam is in contact with any given point along the focal track for only short periods of time. This allows the remaining portion of the track to cool during the time that it takes to rotate back into the path of the electron beam, thereby reducing the amount of heat absorbed by the anode.

While the rotating nature of the anode reduces the amount of heat present at the focal spot on the focal track, a large amount of heat is still present within the anode, the anode drive assembly, and other components within the evacuated housing. This heat must be continuously removed to prevent damage to the tube (and any other adjacent electrical components) and to increase the x-ray tube's efficiency and overall service life.

One approach has been to place the housing that forms the evacuated envelope within a second outer metal housing, which is sometimes referred to as a "can." This outer housing must serve several functions. First, it must act as a radiation shield to prevent radiation leakage, such as that which results from back-scattered electrons previously discussed. To do so, the can must include a radiation shield, which must be constructed from some type of dense, x-ray absorbing metal, such as lead. Second, the outer housing serves as a container for a cooling medium, such as a dielectric oil, which can be continuously circulated by a pump over the outer surface of the inner evacuated housing. As heat is emitted from the x-ray tube components (anode, anode drive assembly, etc.), it is radiated to the outer surface of the evacuated housing, and then at least partially absorbed by the coolant fluid. The heated fluid is then passed to some form of heat exchange device, such as a radiative surface, and then cooled. The fluid is then re-circulated by the pump back through the outer housing and the process repeated.

The dielectric oil (or similar fluid) may also provide additional functions. For example, the oil serves as an electrical insulator between the high voltage potential that exists at the anode and cathode assemblies and the inner evacuated housing, and the outer housing, which is typically comprised of a conductive metal material that is at a different potential, typically ground.

While useful as a heat removal medium and/or as an electrical insulator, the use of oil and similar liquid coolants/dielectrics can be problematic in several respects. For example, use of a fluid adds complexity to the construction and operation of the x-ray generating device. Use of fluid requires that there be a second outer housing or can structure to retain the fluid. This outer housing must be constructed of a material that is capable of blocking x-rays, and it must be large enough to be completely disposed about the inner evacuated housing to retain the coolant fluid. This increases the cost and manufacturing complexity of the overall device. Also, the outer housing requires a large amount of physical space, resulting in the need for an overall larger x-ray generating device. Similarly, the space required for the outer housing reduces the amount of space that can be utilized by the inner evacuated housing, which in turn limits the amount of space that can be used by other components within the x-ray tube. For example, the size of the rotating anode is limited; a larger diameter anode is desirable because it is better able to dissipate heat as it rotates.

Moreover, construction of the outer housing adds expense and manufacturing complexity to the overall device in other respects. If the liquid is used as a coolant, the device may also be equipped with a pump and a radiator or the like, that in turn must be interconnected within a closed circulation system via a system of tubes and fluid conduits. Also, since the fluid expands when it is heated, the closed system must provide a facility to expand, such as a diaphragm or similar structure. Again, these additional components add complexity and expense to the x-ray device's construction. Moreover, the tube is more subject to fluid leakage and related catastrophic failures attributable to the fluid system.

The presence of a liquid coolant/dielectric is also detrimental because it does not function as an efficient noise insulator. In fact, the presence of a liquid may tend to increase the mechanical vibration and resultant noise that is emitted by the operating x-ray tube. This noise can be distressing to the patient and/or the operator. The presence of liquid also limits the ability to utilize other, more efficient materials for dampening the noises emitted by the x-ray tube due to space restrictions and the need for effective electrical insulation.

Finally, use of a dielectric oil type of material is also undesirable from an environmental standpoint. In particular, the oil can be toxic, and must be disposed of properly.

Some prior art x-ray tubes have eliminated the use of an outer housing and fluid as a coolant/dielectric medium, and instead use only a single evacuated housing to enclose the x-ray tube components. Use of a single evacuated housing is advantageous in several respects. For example, eliminating the outer housing reduces the number of components required for the device. This results in a x-ray generating device that is more compact, that is lower in overall cost, that is less complex and easier to manufacture, and that is more reliable. In particular, elimination of the fluid coolant/dielectric reduces complexity and reduces the potential failure points noted above.

However, notwithstanding the recognized advantages of an x-ray generating device having a single evacuated housing, there are a number of problems that have limited its practicability. For example, to prevent excessive radiation from leaking from the x-ray tube, especially in high voltage applications, the housing must be equipped with a layer of x-ray absorbing material, such as a lead liner. However, this adds cost and manufacturing complexity to the device, because the lead shielding must be attached to the housing walls. Similarly, attachment of such a shield creates additional potential failure points that can reduce the reliability of the tube. For example, the shield layer should possess a thermal expansion rate that matches closely that of the underlying substrate material of the housing, or the materials can easily separate in the presence of the extreme temperature fluctuations of the operating x-ray tube.

Moreover, especially in high voltage applications, use of an x-ray shield or liner adds to the thickness of the housing walls, which takes up physical space and results in an overall larger x-ray tube. Again, this limits the amount of space that could otherwise be used by other x-ray tube components, such as a larger diameter anode.

Moreover, use of lead, or similar materials such as beryllium, as a liner material may again be undesirable due to environmental and health concerns elating to the toxicity of the substance. However, other suitable materials can be extremely expensive, can be difficult to manipulate during manufacturing, and/or may not possess satisfactory thermal characteristics for use in an x-ray tube.

To summarize, prior art x-ray generating devices typically rely upon the use of a second outer housing to provide a variety of functions, including cooling of the x-ray tube with a coolant, and preventing excessive radiation emissions. This outer housing adds cost and complexity to the x-ray generating device, and can reduce its long term reliability. While use of a single integral housing would thus be preferable, that approach also has drawbacks. In particular, the approach requires the use of a layer of x-ray shielding material, such as lead, on the housing walls to prevent unwanted radiation emissions. This adds cost and manufacturing complexity to the device, increases its overall size, and may not be desirable from an environmental and safety standpoint.

Thus, what is needed in the art, is a radiographic device, and a method for manufacturing the device, that does not require the use of an outer housing for containing oils or similar fluids for the removal of heat and/or for providing electrical insulation. Moreover, it would be an advancement in the art to provide a radiation generating device that uses a single evacuated housing that is capable of maintaining safe levels of radiation containment without using lead shields and the like.

OBJECTS AND SUMMARY OF THE INVENTION

Given the existence of the above problems and drawbacks in the prior art, it is a primary object of embodiments of the present invention to provide an x-ray generating device, and method of manufacturing the device, which utilizes a single housing for containing the anode and cathode assemblies of the x-ray tube, thereby eliminating the need for an additional external housing for containing coolant and for blocking x-rays. This reduces component count and weight, resulting in a lower cost and are easier to manufacture device. Moreover, it eliminates the need for a environmentally hazardous and difficult to recycle dielectric oil, or similar type fluid, previously used as a coolant and/or dielectric. Another objective is to provide a single evacuated housing that is formed as am integral element that provides sufficient levels of radiation shielding and thereby limits the amount of radiation leakage from the housing to acceptable levels. A related objective is to provide a method for manufacturing the evacuated housing so that this radiation shielding is provided without requiring a separate layer of x-ray blocking material on the housing, such as a lead, or the like. Again, this reduces manufacturing complexity, reduces the overall size of the integral housing, and eliminates the need for bulk materials that are potentially toxic. Yet another objective of embodiments of the present invention is to provide an integral housing that can be manufactured so as to provide for the attachment of external cooling surfaces that convects operating heat from the integral housing and thereby maintain the x-ray tube at acceptable operating temperatures.

These and other objects, features and advantages of the present invention will become more fully apparent from the following description and appended claims, or may be learned by the practice of the invention as set forth hereinafter. Briefly summarized, embodiments of the present invention are directed to an x-ray generating apparatus that eliminates the need for multiple housings for enclosing the x-ray tube components. Instead, embodiments of the present invention utilize a single evacuated housing assembly, preferably formed as an integral unit, for providing the vacuum enclosure that contains the cathode and anode assemblies. Moreover, the integral housing includes a radiation blocking layer that blocks the emission of x-rays to predetermined level; for instance, in preferred embodiments radiation emissions are reduced to a level below that which is mandated by applicable FDA requirements. Preferably, the radiation blocking layer is comprised of a powder metal, that is applied to a the housing substrate with a plasma spraying process. The powder metal is chosen such that it exhibits sufficient radiation blocking characteristics, and such that it satisfactorily adheres to the housing substrate material, even in the presence of extreme temperature fluctuations. This use of a radiation blocking layer eliminates the need for additional and physically separate radiation shield structures, and therefore reduces the overall size of the integral housing. In addition, the need for undesirable materials commonly used in such structures, such as lead and the like, are eliminated.

In other preferred embodiments, the radiation blocking layer is further treated with a composition, again by way of a plasma spraying technique, that permits for the attachment of external structures to the integral housing, such as cooling fins. Preferably, this bond layer facilitates the attachment of the external structure.

In preferred embodiments, the single integral housing is formed as a generally cylindrically shaped body that is capable of forming a vacuum enclosure. Disposed within the integral housing is a cathode assembly having an emission source for emitting electrons. In an illustrated embodiment, the cathode assembly is supported so as to be positioned opposite from a focal track formed on a rotating anode, although the integral housing could also be used in x-ray generating devices having a stationary anode. The focal track is positioned on the anode so that x-rays are emitted through a window formed through the side of the integral housing. In one preferred embodiment, an x-ray passageway is positioned between the anode target and the window. The passageway is sized and shaped so as to prevent backscattered or secondary electrons from reaching the window area and generating excessive heat.

Preferred embodiments of the present invention utilize a forced air convection system to remove heat that is transferred to the outer surface of the integral housing, and to remove heat emitted from the stator, or motor assembly that is used to rotate the anode. Again, this eliminates the need for coolant fluids, such as dielectric oil and the like, and therefore eliminates the problems inherent with the use of such fluids. In one embodiment, a fan is used to direct air over the outer surfaces of the integral housing; preferably the air flow is directed with an air flow shell that is disposed about at least a portion of the integral housing. Also, in preferred embodiments, the integral housing includes external air "fins" for facilitating the transfer of heat away from the housing.

Presently preferred embodiments of the present invention also include means for insulating the evacuated housing—both in an electrical sense and in an audible noise sense. In one embodiment, a dielectric polymer material, such as a polymer gel, is disposed at specific regions of the housing. The polymer provides two functions: it electrically insulates the high voltage connection to the anode and cathode assemblies, thereby preventing arching and charge up of the evacuated integral housing; and it acts as a damping material and absorbs vibration and noise that originates from the anode rotor assembly. Reduced noise emissions are especially important to maintain the comfort of the patient and to help reduce any anxiety that would otherwise result from high noise emissions.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
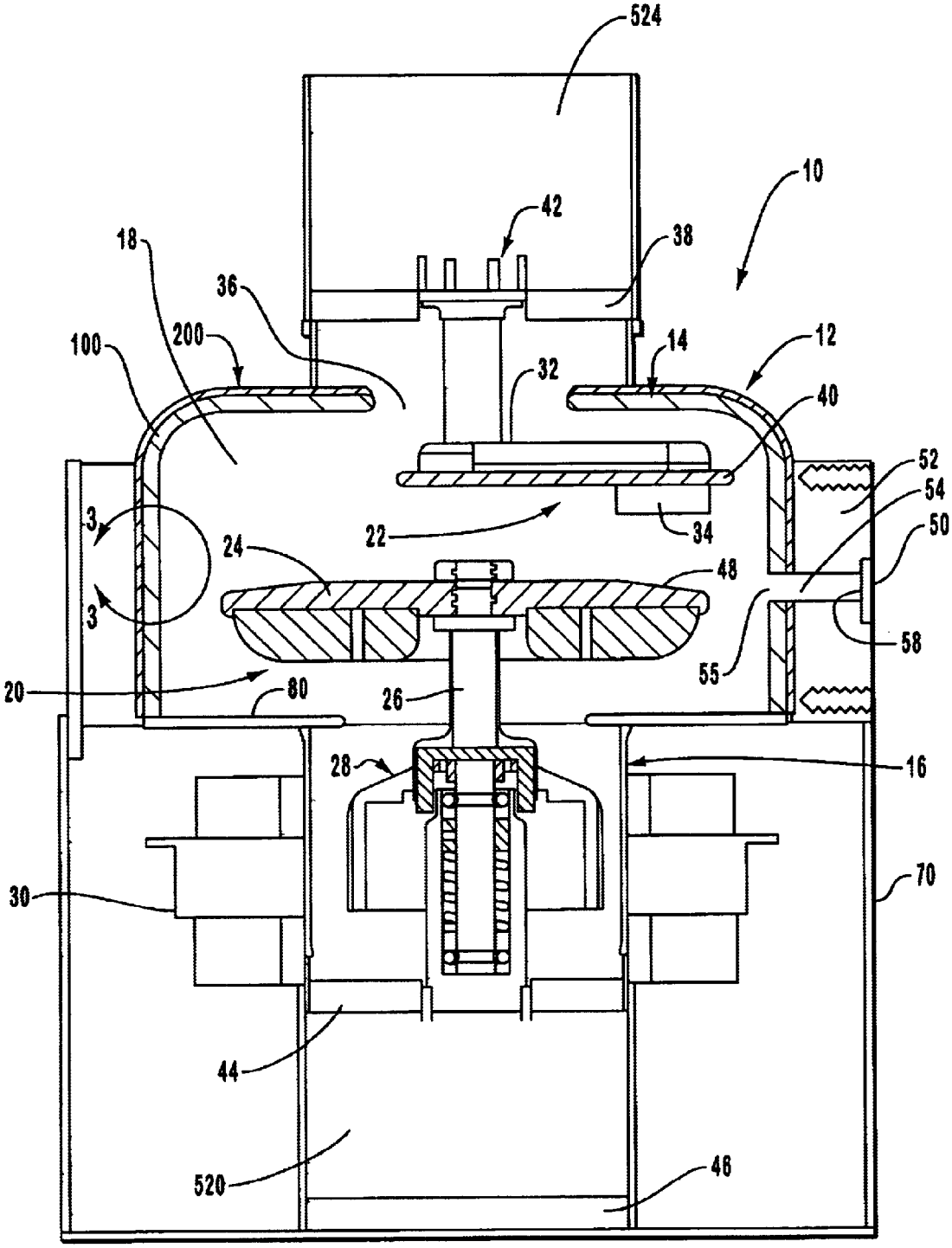
FIG. 1 is a cross-sectional view of an x-ray generating apparatus embodying one presently preferred embodiment of an evacuated housing of the present invention.

Reference will now be made to the drawings, wherein exemplary embodiments of the present invention are illustrated. Reference is first made to FIG. 1, which illustrates a cross-sectional view of an example x-ray tube assembly, designated generally at 10, which is constructed with a single housing assembly, designated generally at 12. In the presently preferred embodiment, the housing 12 is formed as a substantially integral housing with a first envelope portion 14 and a second envelope portion 16 joined so as to define an evacuated enclosure 18. Disposed within the vacuum enclosure 18 are the various x-ray tube components, including the rotating anode assembly, designated generally at 20, and the cathode assembly, designated generally at 22. The rotating anode assembly 20 includes an anode target 24 which is connected via a shaft 26 to a rotor assembly 28 for rotation. A stator 30 is disposed outside the integral housing 12 so that it is proximate to the rotor assembly 28, for use in rotating the anode 24 in a manner that is well known in the art. The cathode assembly 22 includes a mounting structure 32, which supports an electron source 34, such as a filament (not shown), and associated electronics. In the illustrated embodiment, the cathode assembly 22 is placed within the vacuum enclosure 18 through an opening 36 that is formed through the wall of the housing 12. In addition, a vacuum tight seal is formed with a ceramic insulator 38, or the like. In the illustrated embodiment, the cathode assembly 22 also includes a disk structure 40 that is used to support the electron source 34. Preferably, the disk is constructed of an x-ray blocking material, and the diameter of the disk 40 is chosen so as to shield the opening 36.

A connector assembly 42 for connecting the cathode assembly 22 to an external high voltage power source (not shown) passes through the opening 36 and the ceramic insulator 38. In a like fashion, a connector and associated electrical wires (not shown) pass through a second ceramic insulator 46 for connecting the anode assembly 20 to the external high voltage power source. As is well known, during operation the high voltage power source is used to create a high voltage potential between the cathode assembly 22 and the anode assembly 20. For example, in some applications the anode assembly 22 is maintained at a positive voltage of about +75 kV while the cathode assembly 22 is maintained at an equally negative voltage of about −75 kV. Depending on the particular application involved, other voltage potentials could also be used. This voltage potential causes the electrons that are emitted from the emission source of the cathode 34 (i.e., a thermionic filament) to accelerate towards and then strike the surface of the anode 24 at a focal point position on a focal track 48, which is comprised of molybdenum, or a similar high Z material. Part of the energy generated as a result of this impact is in the form of x-rays that are then emitted through an x-ray transmissive window 50 that is formed through a side of the integral housing 12 at a point adjacent to the anode 24.

While other approaches could be used, in the illustrated embodiment the window 50 is positioned within a mounting block 52 that is mechanically affixed to the integral housing 12. Preferably, the mounting block 50 has formed therein a passageway 54 with an opening 54 located at a point adjacent to the focal track 48, and an opening 58 adjacent to the window 50. In a preferred embodiment, the x-ray opening 56 in the side wall of housing 12 is smaller than the opening provided by the window 50. The remote positioning of the window 50 from the anode target 48, and the smaller size of the passageway 54, together function to reduce the temperature of the window 50. In particular, in operation the temperature within the vacuum enclosure is higher in the window area due to the contribution of "secondary" electron bombardment from electrons back scattered from the focal spot on the anode target 24. Since such secondary, or back scattered electrons are scattered at random angles, the resulting trajectories allow only a small portion of them to reach the window area because of the orientation and relative size of the passageway 54, and the distance to the window 50. At the same time, the configuration allows the on-focus radiation, i.e., that radiation that results from the on-focus electrons striking the focal spot, to pass through the passageway 54 and exit the window 50. In presently preferred embodiments, the length of the passageway 54, prevents backscattered electrons from reaching the window 50.

In the embodiment illustrated in FIG. 1, heat can be removed from the surface of the housing 12 by way of forced air convection. For example, air flow over the outer surface of portions of the integral housing 12 can be provided by way of a fan mechanism (not shown). In addition, the air flow can be controlled via an air flow shell 70 that is disposed about at least a portion of the housing 12. The shell 70 is preferably constructed of a polycarbonate, or similar material, and is oriented so as to control and contain air flow. In the preferred embodiment, the fan is operably connected so as to pull air flow through the shell. In alternative embodiments, the shell 70 may be provided with a ground plane, and thus will either include at least a portion of electrically conducting material, or may be completely fashioned from a conductive material, such as a thin layer of sheet metal.

In the illustrated embodiment, at least a portion of the first envelope portion 14 of the integral housing 12 serves as a radiation shield. For example, critical areas of the integral housing 12 should be capable of lowering radiation transmission to a predefined safety level, such as to one fifth of the FDA requirement, which equals 20 mRad/hr at 1 meter distance from the x-ray generating apparatus with 150 KV potential maintained between anode and cathode assemblies at rated power of the beam. As noted above, one objective is to provide satisfactory radiation shielding without having to utilize a separate shielding plate made out of lead or a similar material. Moreover, it is an objective to keep the thickness of the housing wall as thin as possible, so as to reduce the physical space needed by the housing 12 and maximize the space available to other x-ray tube components, such as the anode disk 24. A separate shield structure is not conducive to this objective. Moreover, if a housing constructed only of copper were utilized, the thickness of the top and side walls of the vacuum enclosure would need to be approximately 1.35 inches to achieve the required radiation protection, resulting in an much larger housing 12. Alternatively, if a material such as solid Molybdenum were only used, a thickness of approximately 0.58 inches is required. However, the high cost of Molybdenum would result in a housing that is prohibitively expensive. Embodiments of the present invention address these and other design problems.

In particular, preferred embodiments of the present invention utilize a housing 12 that is constructed of a substrate material that is coated with an x-ray blocking medium that achieves the desired x-ray blocking function. In preferred embodiments, the substrate, together with the x-ray blocking coating, provides a sufficient level of radiation shielding, and does so with a significantly reduced housing wall thickness, and in a manner that is relatively inexpensive when compared to high cost shielding materials such as Molybdenum. In addition, the approach can be implemented in a manner that eliminates the need for shielding materials having environmental, toxicity and health concerns, such as lead and beryllium.

Figure 2:
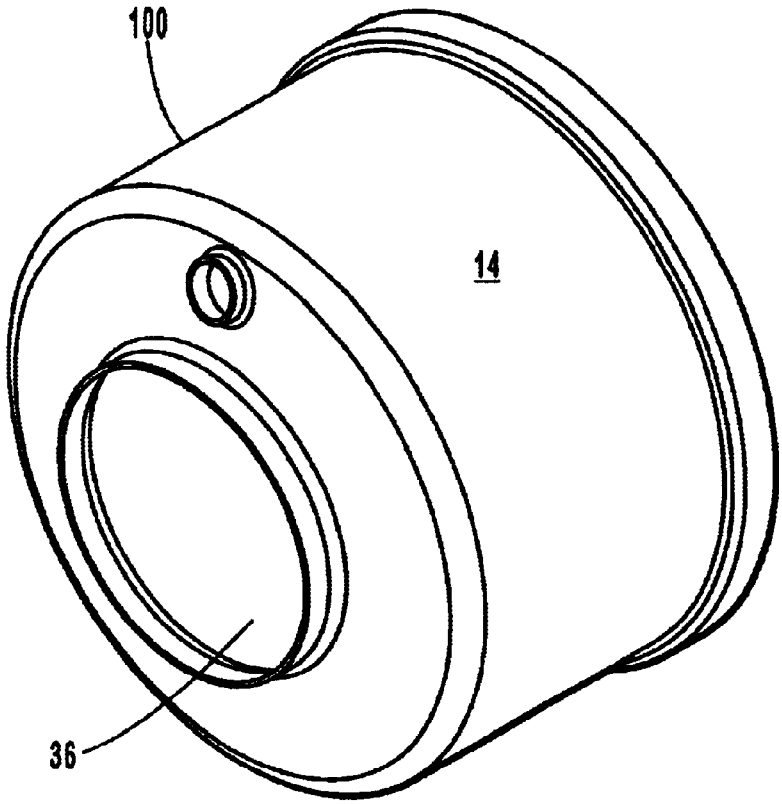
FIG. 2 is a perspective view of one preferred embodiment of the substrate portion of an integral housing.

In a presently preferred embodiment of the present invention, at least a portion of the housing 12, such as the first envelope portion 14, is comprised of a substrate housing portion 100. Substrate 100 is formed into the desired shape of the first envelope portion, such as is illustrated in FIG. 2, using any suitable manufacturing process.

The material used to form substrate housing portion 100 should preferably be substantially non-porous so as to provide vacuum integrity to the integral housing 12, and should possess a thermal expansion coefficient that is substantially similar to that of the radiation shield coating (described below) so as to avoid spalling, flaking or similar types of failure resulting form thermal mismatch between materials. Moreover, the material used for substrate portion 100 should have sufficient thermal capacity so as to permit the integral housing to function as a thermal reservoir of heat dissipated by from the anode assembly, and that is capable of conducting heat away from the anode assembly. In a presently preferred embodiment, the substrate portion is constructed of Kovar™, which is a commercially available material. Other potential materials include, but are not limited to, Alloy 46 (an alloy of nickel and iron); nickel; copper; stainless steel; molybdenum; alloys of the foregoing, and other materials having similar characteristics. In a preferred embodiment, the Kovar housing portion 100 is formed so that the walls have a thickness of approximately 0.05 inches, although other thicknesses could be used depending on the particular x-ray generating device application involved.

Once the substrate material has been formed into substrate housing portion 100 of desired shape, in a preferred embodiment the substrate housing is cleaned so as to remove any surface impurities that could contaminate the evacuated environment of the x-ray tube and/or prevent suitable adhesion of the radiation shield coating (described below). For example, the substrate housing 100 can be sand blasted with an appropriate material, such as aluminum oxide at 45 psi, and then degreased with an appropriate cleaning solution, such as Dynadet™ and/or a hydrochloric solution.

Depending on the configuration of the x-ray tube, there may be additional components that are subsequently brazed to the outer surface of the substrate housing 100. Thus, in one presently preferred embodiment, at least a portion of the surface of the substrate housing 100 can be plated with an appropriate material, such as nickel, so as to enhance the ability to braze or weld other structures to the outer surface of the housing 100. In one embodiment, this braze enhancing nickel layer is approximately 400–600 micro-inches in thickness, an is applied with an suitable plating processes; for example 28 amps for 25 minutes can be used for a suitable plate layer.

In the preferred embodiment, once the braze enhancing layer as been applied, the substrate housing 100 is again cleaned to remove impurities, again with any appropriate cleaning method such as sand blasting and ultrasonic cleaning.

In preferred embodiments, a radiation shielding layer is then applied to the underlying substrate. The material is comprised of a metal composition that is capable of being applied as a coating to the substrate and, in preferred embodiments, is comprised of a powder metal that can be applied with conventional plasma coating or spraying techniques. In general, the characteristics of the desired material provide a predetermined level of radiation shielding, and in a manner such that the thickness of the resulting layer is minimal. Moreover, the powder metal preferably has a thermal rate of expansion that matches closely that of the underlying substrate, thereby reducing the occurrence of any cracking, spalling or separation of the radiation shield layer from the substrate during heating and cooling of the x-ray generating device.

By way of example and not limitation, one presently preferred powder metal that has the above characteristics is a Tungsten and Iron alloy combination, which are each in a powder form and then mixed together to provide a powder combination. In one preferred embodiment the combination is approximately 10% iron by weight, and 90% tungsten by weight. However, it will be appreciated that different ratios of the two metals can be used; for example, the proportion of iron can range from 0 to 50%. In this particular mixture, the tungsten component provides the requisite radiation shielding characteristics. Consequently, the amount of tungsten used will dictate to a greater degree the level of radiation shielding that is provided by the sprayed on layer, and the amount used will thus dictate the thickness of the layer required. In the illustrated embodiment, the iron constituent provides the mixture with a better thermal match with the underlying Kovar substrate material, and thus ensures a better bond between the radiation shielding layer and the substrate, especially given the thermal conditions present.

It will be appreciated that other constituent components could be used as alternatives to the preferred iron and tungsten powder mixture. For example, in place of tungsten, other dense x-ray absorbing materials that are capable of providing a radiation shielding function could be used, including but not limited to: various tungsten alloys (e.g., densimet, heavy metal alloy); copper; molybdenum; tantalum; steel; bismuth; lead; and alloys of each of the foregoing. Obviously, use of the different metals have varying tradeoffs; for example, some would require a thicker shielding layer on the substrate to provide a requisite level of radiation shielding. Further, use of different metal powder mixtures may be dictated by the particular type of substrate material being used.

Similarly, other components could be used in place of the iron, again depending on the particular characteristics that are desired. For example, satisfactory substitutes include, but are not limited to, copper, nickel, cobalt, aluminum and others. Again, specific choices may depend upon the particular design objectives. For example, one metal may be chosen depending upon the type of substrate being used so as to achieve a proper thermal expansion rate match. Also, the metal should be capable of being alloyed with the other constituent of the powder metal mixture.

Figure 3:
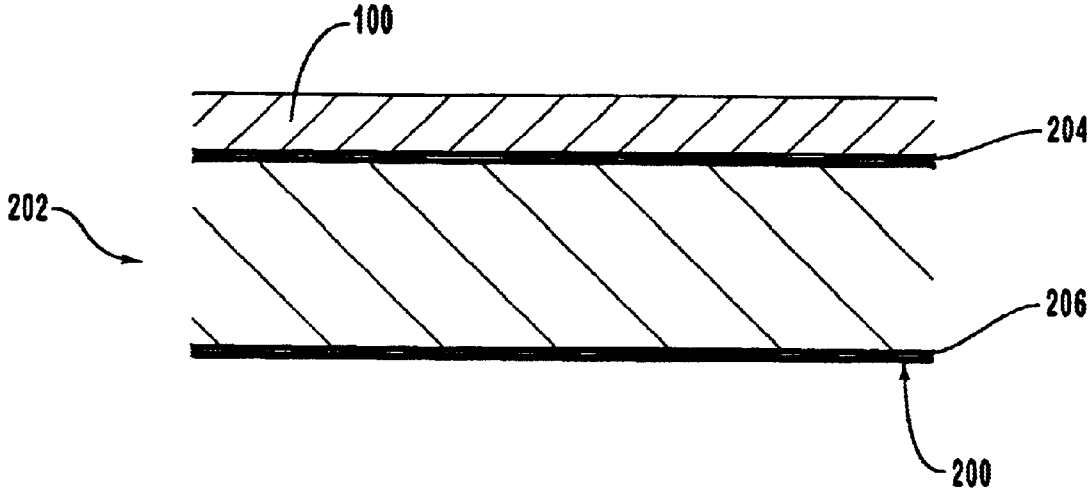
FIG. 3 is an exploded view of the cross-section taken at lines 3—3 in FIG. 1, illustrating in further detail one presently preferred configuration of the radiation shield layer.

"A presently preferred embodiment of the radiation shield layer 200 is shown in cross section at lines 3—3 in FIG. 1, which is shown in further detail in FIG. 3. FIG. 3 illustrates how, in one embodiment, the radiation shield layer 200 is comprised of the metal powder layer 202 that is applied with a plasma spraying technique (described in further detail below) to the housing substrate 100. In addition, in one preferred embodiment, an adhesion, or first bonding layer, designated at 204, is applied between the substrate 100 (or the nickel plate layer, if used) and the metal powder layer 202. This layer functions so as to facilitate a better adhesion between the substrate 100 and the sprayed on metal powder layer 202. Preferably, the bonding layer 204 is comprised of a roughened surface that provides a mechanically compliant layer between substrate 100 and metal powder layer 202. For example, in a presently preferred embodiment, the bond layer 204 is known as Metco 451 (available from Sulzer Metco), or the like, that is applied with a plasma spray process. It will be appreciated that the layer could be provided with other techniques as well including, for example, mechanical or chemical etching of the substrate surface."

"In addition to the first bond layer 204, presently preferred embodiments also include a second bond layer, as is designated at 206 in FIG. 3. As will be described in further detail below in connection with FIG. 4, in some embodiments, external structures, such as cooling fins, are brazed/welded to the surface of the integral housing 12. The second bond layer 206 is provided so as to facilitate the bond between the radiation shield layer 200 and any such external structure. Moreover, the material used in the layer would preferably possess characteristics that facilitate the bond. For example, to facilitate brazing of a copper fin to the housing 12, the second bond layer 206 would preferably be comprised of a thin layer of a copper or copper alloy material. Again this layer can be applied via a plasma spray process."

As noted, in presently preferred embodiments, the radiation shield layer 202 and the first and second bond layers 204, 206 are preferably applied via a plasma coating or spraying process. In one embodiment, the plasma spraying technique used is an Atmospheric Plasma Spray (APS) device. Other plasma spraying processes could also be used, including Low Pressure Plasma Spray process; High Velocity Oxy Fuel Spray process; and a plasma jet process.

By way of example, and not limitation, following is a description of one presently preferred process for applying the radiation shield layer 200. First, an appropriate powder metal composition is prepared, which in one embodiment is the Tungsten and Iron mixture. Appropriate quantities of the tungsten powder and the iron powder are mixed (e.g., 0.5 Kg of iron powder with 4.5 Kg of tungsten powder) and rolled for 30 minutes so as to effect complete mixture. The mixture is then vacuum fired, such as for 3 hours in a 500° Celsius.

Once the powder metal mixtures are prepared, in the presently preferred embodiment, the next step is to apply the first bond layer with the plasma sprayer to the prepared substrate housing 100. As noted, this can be any appropriate substance that provides a layer that will facilitate adhesion between the substrate 100 and the powder metal layer 202. The appropriate powder material is supplied to the plasma spray gun (or equivalent) and then applied to the appropriate surfaces of the substrate housing 100. As is well know, plasma spraying techniques utilize a reactive gas and an applied voltage to create an arc and a resultant hot plasma. The powder mixture is injected into the plasma and then forced out under pressure with air and accelerated towards the surface of the housing 100. The melted powder then "sticks" to the surface of the housing 100.

Once the first bond layer 204 has been applied, the radiation shield powder mixture is then applied in a similar fashion. In preferred embodiments, this is the tungsten and iron mixture. In one preferred process, the radiation shield layer comprised of tungsten and iron is applied with a series of plasma spray applications, until a desired thickness is obtained. In addition, in a preferred process, between each layer application, the housing 100 is placed in a pusher furnace at an appropriate setting, such as 650° Celsius wet hydrogen. As noted, the thickness of the final radiation shield layer will depend on the particular material being used and the amount of shielding desired. For example, in using tungsten powder, it has been found that as little as 0.085 inches provides safe shielding. In one preferred embodiment using the tungsten and iron powder mixture, a layer of approximately 0.175 to 0.205 inches (including the first bond layer 204) is achieved.

In practice, when the powder metal material is plasma sprayed onto the substrate 100, the resultant layer does not typically include the same proportion by weight of the starting materials. For example, a small percentage of the tungsten will not permanently adhere to the substrate surface.

Once the shield layer 202 is applied, the second bond layer 206 is applied, if needed. Again, this layer is preferably applied with a plasma spray process, and the material used is dependent upon the composition of the elements that will be subsequently attached to the housing 12. For example, in a preferred embodiment, copper air flow fins (see FIG. 4 below) are brazed to the surface to facilitate the removal of heat from the body of the housing 12. As such, the second bond layer 206 is made from a plasma sprayed layer of a powder copper material.

Once the entire radiation shield layer 200 has been applied to the substrate 100, in a preferred embodiment, the housing 12 is run through a pusher furnace at an appropriate temperature; in the preferred embodiment at 650° Celsius wet hydrogen. The housing 12 is then cleaned ultrasonically for 5 minutes.

Figure 4:
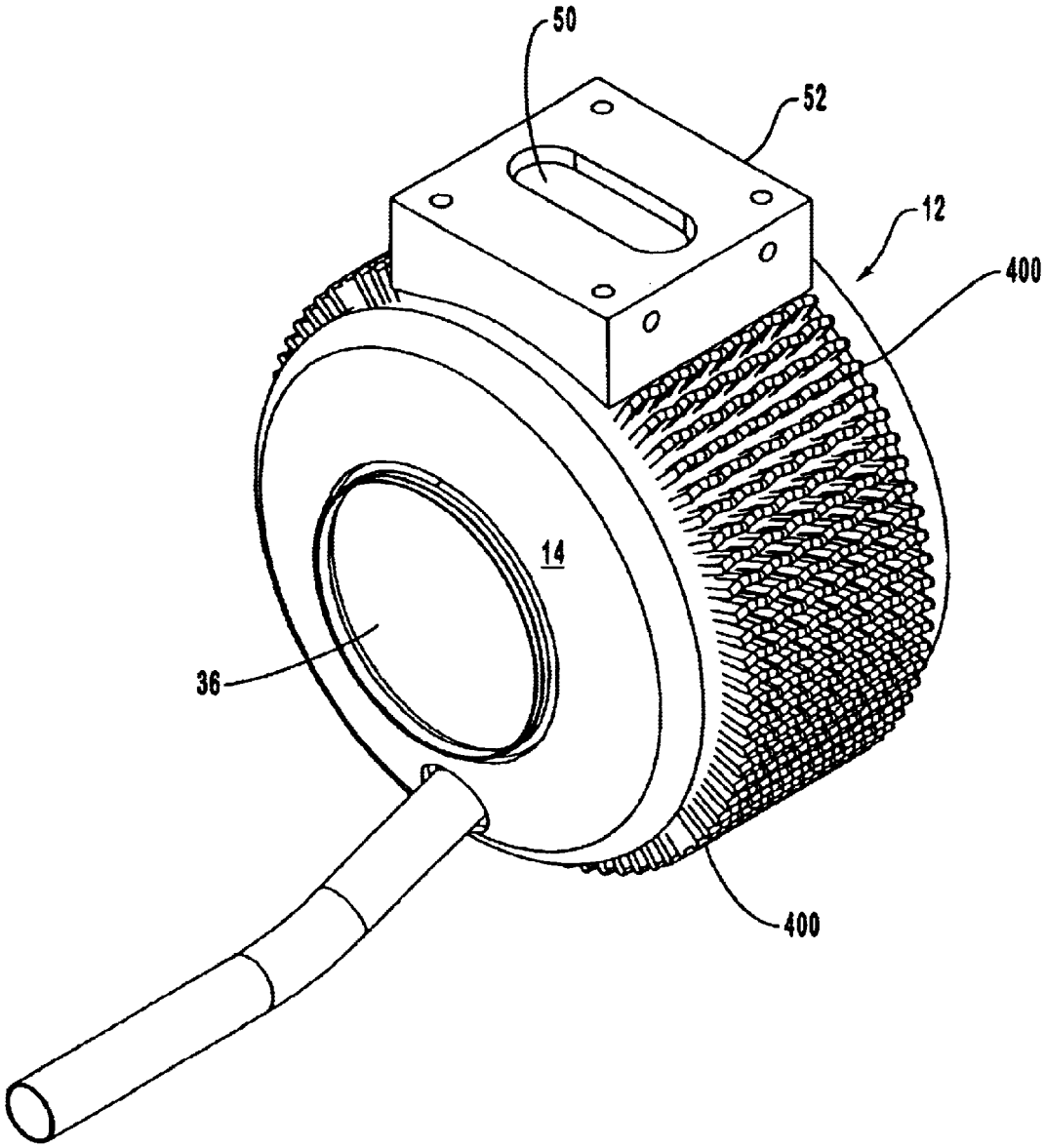
FIG. 4 is a perspective view of an embodiment of one integral housing having fins disposed thereon.

Reference is next made to FIG. 4, which illustrates a presently preferred embodiment of the first envelope portion 14 of integral housing 12. The integral housing 12 includes a radiation shield layer 200, applied in a manner previously described, and thus is capable of blocking radiation from leaking through the housing 12 during operation of the x-ray generating device. As noted, another function provided by the integral housing 12 is to absorb and thermally conduct heat away from the anode assembly 20, which is generated during operation, to a point external to the housing 12. Depending upon the particular x-ray tube application, embodiments of the integral housing may include a means for increasing the rate of heat transfer from the integral housing to the region outside the housing enclosure. FIG. 4 illustrates one example of a structure for providing this function, which is a plurality of fins 400 placed over the perimeter of the integral housing 12. The fins 400 are sized and oriented so as to increase the effective outer surface area of the housing 12, so as to thereby increase the effective rate of heat that can be transferred from the housing body 12 to the adjacent air. Also, some embodiments may include a fan (not shown) or other form of force air device, for providing a forced air convection across the surface of the fins 400 to further enhance the heat removal. In the illustrated embodiment, the fins are comprised of a copper material, and are brazed to the outer surface of the integral housing 12. As discussed, the outer second bond layer 206, also comprised of copper, enhances the bond between the housing 12 and the copper fins 400. It will be appreciated that, as an alternative to the illustrated fins, other structural configurations could be affixed to the integral housing for effecting heat removal as will be apparent to those of skill in the art.

It will also be appreciated that while the above radiation shield 200, and method of application, has been described in the context of the illustrated integral housing 12, that this type of radiation shielding can be used in connection with any housing configuration and shape, and in connection with any x-ray tube component that requires x-ray shielding. For example, in FIG. 1, the disk 40 supporting the cathode 34 can function so as to block x-rays from exiting the opening 36. Instead of placing a solid piece of lead, or similar x-ray dense material, the disk 40 can be fabricated with a radiation shield 200 in the manner previously described. A similar shield could be placed upon the surface of the anode plate 80 formed on the side of the anode 24 that is opposite from the cathode assembly 22. Again, use of this type of radiation shielding results in a component that has a smaller overall size, and which thereby frees up component space within the housing 12. Such shielding techniques can be used in other areas of the x-ray generating device as well.

Figure 5:
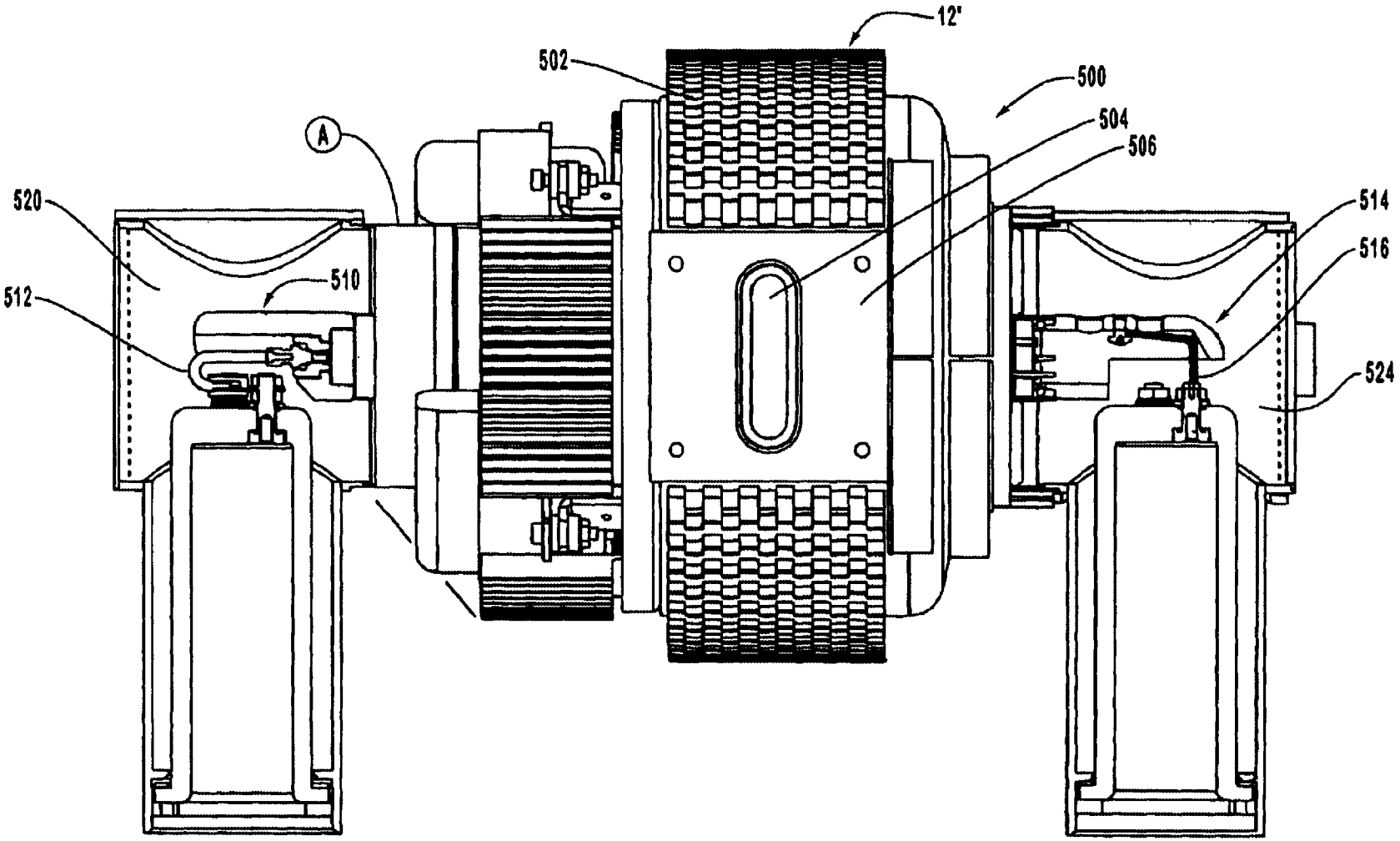
FIG. 5 is a side elevational view illustrating another embodiment of an x-ray generating apparatus embodying other presently preferred embodiments.

FIG. 5 illustrates yet another embodiment of an x-ray tube environment, designated at 500, utilizing an embodiment of the integral housing of the present invention. An integral housing is designated at 12'. The housing 12' includes a radiation shield 200 fabricated in accordance with the above discussion, and also includes heat dissipation fins 502 formed about the periphery of the housing 12. The device further includes a window mounting block 506 and x-ray window 504 similar to that previously described in connection with FIG. 1.

FIG. 5 also illustrates additional elements utilized by presently preferred embodiments of the present invention. In particular, one example of the manner in which certain of the electronics used to electrically connect the anode assembly and the cathode assembly to an external voltage supply (not shown) are illustrated For example, the high voltage connector assembly 510 for connecting the anode assembly (disposed within housing 12'), along with exposed wire 512, to as supply voltage of +75 kV (for example) is shown. Likewise, the figure illustrates the high voltage connector assembly 514 for connecting the cathode assembly (disposed within housing 12'), along with exposed wire 516, to a supply voltage of −75 kV. As discussed, the present embodiment utilizes a single integral housing 12', and thus does not have a dielectric oil present to electrically isolate the above connectors and wires from the rest of the housing, which is at ground potential (point A, for example). As such, absent any isolation, the assembly would be subject to electrical arching and the like.

In the present embodiment, this is addressed by placing a dielectric gel material within the reservoirs that contain the exposed electronics, shown at 520 and 524, and so as to be disposed directly about the high-voltage insulators of the tube. The gel provides a means for electrically insulating the portions of the assembly at ground potential from those parts that are at a high differential voltage.

In general, the preferred gel must be a dielectric, and preferably should be capable of withstanding temperature cycling between, for example, 0 and 200 degrees Celsius without cracking or separating. Presently preferred polymer materials include GE, RTV 60; Dow Coming, Sylgard 577; Dow Coming, Dielectric Gel 3-4154; Epoxy; bakelite; thermal set plastic. One advantage of the epoxy or thermal set plastics is that they do not require an exterior containment structure. Another advantage of using these types of gels is that they function to reduce the operating noise of the x-ray tube.

In summary, the above described x-ray tube assembly provides a variety of benefits not previously found in the prior art. A tube assembly utilizing the described integral housing having the radiation shield layer eliminates the need for a second external housing, as well as the need for a fluid coolant cooling system and/or fluid dielectric. Moreover, the integral housing provides sufficient radiation blocking, and does so without the need for lead plating or other like materials having environmental and safety concerns. Moreover, the radiation shield layer is applied in a manner so as to result in a housing with walls having minimal thickness, thereby resulting in a smaller dimensioned outer housing structure. This results in a single x-ray tube integral housing that can be constructed in a smaller space, and that can utilize, for instance, a larger rotating anode disk, which further improves the thermal performance of the x-ray tube. Moreover, the assembly utilizes a unique dielectric gel that provides for both electrical isolation of the integral housing, and also greatly reduces noise that is emitted during operation.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An x-ray generating apparatus comprising:

an integral housing forming a vacuum enclosure, the integral housing being at least partially comprised of a material having a first predetermined rate of thermal expansion;

a shield layer that is applied to at least a portion of the integral housing, the shield layer being formed from a mixture of a plurality of powder metals, wherein at least one of the powder metals has a rate of thermal expansion that substantially matches the first predetermined rate of thermal expansion, and wherein at least one of the powder metals provides a predetermined level of radiation attenuation;

an anode assembly having a rotating anode with a target portion, the rotating anode being disposed within the vacuum enclosure; and a cathode assembly, disposed within the vacuum enclosure, having an electron source capable of emitting electrons that strike the target portion to generate x-rays which are released through a window formed through a side of the integral housing, and wherein a substantial portion of any generated x-rays are prevented from escaping through that portion of the integral housing having the shield layer applied thereto.

2. An x-ray generating apparatus as defined in claim 1, further comprising means for increasing the rate of heat transfer out of the integral housing.

3. An x-ray generating apparatus as defined in claim 2, wherein the means for increasing the rate of heat transfer is comprised of a plurality of fin structures affixed to the integral housing.

4. An x-ray generating apparatus as defined in claim 3, further comprising a second bond layer that is interposed between the powder metal shield layer and each of the plurality of fins.

5. The x-ray generating apparatus as defined in claim 1, wherein one of the powder metals includes tungsten.

6. The x-ray generating apparatus as defined in claim 1, wherein one of the powder metals includes iron.

7. The x-ray generating apparatus as defined in claim 1, wherein one of the powder metals comprises iron and another of the powder metals comprises tungsten.

8. The x-ray generating apparatus as defined in claim 1, further comprising a first bond layer interposed between the integral housing and the shield layer.

9. The x-ray generating apparatus as defined in claim 8, wherein the first bond layer comprises a powder metal.

10. The x-ray generating apparatus as defined in claim 8, wherein the first bond layer includes at least one of: copper; nickel; cobalt; aluminum; iron; and alloys of the foregoing.

11. The x-ray generating apparatus as defined in claim 8, wherein the first bond layer comprises a roughened base substrate surface.

12. The x-ray generating apparatus as defined in claim 8, wherein the first bond layer comprises an etched base substrate surface.

13. The x-ray generating apparatus as defined in claim 1, wherein the shield layer has a width that is less than or equal to about 0.205 inches.

* * * * *